US006129523A

United States Patent [19]

Ruhnke

[11] Patent Number: 6,129,523

[45] Date of Patent: Oct. 10, 2000

[54] AIR PURGING CIRCULATOR

[76] Inventor: John Ruhnke, 1 Thistle Rd., Norwalk, Conn. 06851

[21] Appl. No.: 09/057,643

[22] Filed: Apr. 9, 1998

Related U.S. Application Data

[60] Provisional application No. 60/043,655, Apr. 11, 1997.

[51] Int. Cl.[7] ..... F04D 9/00

[52] U.S. Cl. ..... 417/313; 417/435; 96/197; 237/63

[58] Field of Search ..... 417/435, 313; 96/196, 197, 220; 237/63

[56] References Cited

U.S. PATENT DOCUMENTS

| | | | |
|---|---|---|---|
| 3,074,645 | 1/1963 | Main | 237/63 |
| 3,271,933 | 9/1966 | Harker et al. | 55/203 |
| 3,276,188 | 10/1966 | Carlson | 237/63 |
| 3,290,864 | 12/1966 | Harker et al. | 55/203 |
| 3,377,778 | 4/1968 | Gaertner | 328/233 |
| 4,358,299 | 11/1982 | Jensen et al. | 55/204 |
| 4,381,928 | 5/1983 | Roffelsen | 55/170 |
| 4,447,189 | 5/1984 | Jensen et al. | 415/168 |
| 4,775,292 | 10/1988 | Jensen et al. | 415/168 |
| 4,787,816 | 11/1988 | Jensen et al. | 415/168 |
| 5,123,938 | 6/1992 | Nobel | 55/170 |
| 5,490,874 | 2/1996 | Kuster et al. | 96/204 |
| 5,501,246 | 3/1996 | Burns et al. | 137/179 |

FOREIGN PATENT DOCUMENTS

| | | |
|---|---|---|
| 1937119 | 2/1971 | Germany . |
| 23 46 286 | 9/1973 | Germany . |
| 31 09 918 | 10/1982 | Germany . |
| 71962 | 4/1947 | Norway . |

OTHER PUBLICATIONS

"Spirovent Air Eliminators"; Spirotherm, Inc., Oct. 1995.

Bell & Gossett brochure; "Hydro–Flo" Enhanced Heating Module (1996).

*Primary Examiner*—Andrew M. Dolinar

*Attorney, Agent, or Firm*—St. Onge Steward Johnston & Reens LLC

[57] ABSTRACT

An air purging circulator is provided with a reservoir on the suction side of an impeller chamber in a circulation pump, to allow circulating water to reduce its velocity, and remove air from the lowest pressure point in the system, the suction side of the circulator, where the least amount of dissolved air is present in the circulating water, so that entrained air in the water is released, and vented from the system. The flanged inlet and outlet apertures of the pump housing are axially aligned, and preferably are located at one end of the pump housing opposite from the motor, to allow convenient installation in retrofit of existing systems. Separation media, such as marbles, wire mesh, or crumpled wire, to further slow the water flow and enhance separation of the air from the water, can be provided in the reservoir.

25 Claims, 4 Drawing Sheets

AIR PURGING CIRCULATOR

This application is based on, and I claim priority to U.S. Provisional Patent Application Ser. No. 60/043,655, filed Apr. 11, 1997.

BACKGROUND OF THE INVENTION

Air can enter a hydronic (hot water) heating system in number of ways. Most typically, air enters the system as a result of some repair or replacement of a component of the system. If, for example, a boiler is replaced, the entire system typically must be drained and refilled with water.

The removal of air in a hot water heating system is conventionally done in two steps. The first step is to remove the large pockets of air by purging the system with a hose. The second step is to remove the left-over smaller pockets of air by an air scoop or microbubbler.

In the first step, a shut-off valve is opened on the fill line leading to the boiler and the system is filled until 12 psi is reached. Then a hose is attached to a drain valve in the system piping and the shut-off valves for each split off of each zone are closed. The drain valve is opened and the pressure is increased in the system by adjusting the fill valve to let water into the system. If that doesn't work, the fill valve must be bypassed with a double-end hose. Most of the time the drain valves are not properly placed to do this. The water is then circulated through the system until new water replaces the water already in the system. The hose is then moved to the next drain valve and the step of circulating water to replace existing water with new water is repeated for each split of each heating loop. This task takes 1.25–2.5 hours and must be added to every repair done in the system. If the fill valve breaks due to excessive pressures during filling of the system, the entire process may have to be repeated.

In the second step, after the biggest pockets of air are gone, small bubbles remain, causing gurgling noises in the pipes of the hot water system. These small bubbles are removed by air scoops or microbubblers installed in the system. If properly installed, these devices will eventually purge most of the remaining air within 24 hours and the system should circulate smoothly and quietly.

If the smaller bubbles are not removed, they can accumulate into bigger pockets of air. These large pockets of air, if they are drawn through the system to the impeller chamber of the circulator, can cause stalling of circulation of the water through the system, so that no heat is delivered to the radiators located downstream of the circulator. In other cases, the air pocket can become trapped in one of the zones of the heating system, preventing circulation through that zone. If these problems occur in the winter, there is the possibility of the pipes freezing and bursting if the problems are not promptly solved.

A number of systems have been proposed to provide gas separation equipment in a hyrdronic heating system, but to date, none of the proposed systems have been suitable for use in retrofit applications, i.e., installation into preexisting hydronic heating systems. Thus, the system in U.S. Pat. No. 3,290,864 is complicated, and would require expensive repiping to install in a preexisting system due to the non-standard positioning of the pump inlet and outlet; and due to the inability to install the pump where system piping is run close to a wall. The system in U.S. Pat. No. 4,775,292 is not suitable for orientation in more than one direction, thus limiting its application to limited situations where a prexisting circulator pump is oriented in the same way as the intended use of the system shown in this patent. In addition, this system would not be useful to install the pump where system piping runs close to a wall.

It would be desirable to provide a circulator for hydronic systems which can automatically remove air in the system, without need for laborious hose purging of the system, and which is suitable for retrofit applications regardless of the positioning or orientation of the existing circulator or piping in the system.

SUMMARY OF THE INVENTION

In accordance with one embodiment of the invention, an air purging circulator comprises a pump housing having a flanged inlet aperture and a flanged outlet aperture, with a reservoir and impeller chamber located therebetween. The impeller chamber is at one end of the housing and contains an impeller driven by an electric motor. The flanged inlet and outlet apertures of the pump housing are axially aligned, and preferably are located at one end of the pump housing opposite from the motor. In this embodiment the air purging circulator is particularly well adapted to use in retrofit of existing systems, even where piping is close by a wall. Preferably, the distance between the inlet and outlet apertures of the pump housing is selected to match the distance between flanges in conventional circulators, to allow easy retrofit.

The inlet aperture connects to an air purging reservoir, which is upstream of and connects to the impeller chamber. The impeller chamber preferably connects to the flanged outlet aperture in the pump housing by a curved tube that extends from the impeller chamber, at the inlet aperture side of the housing, to the outlet aperture.

The air purging reservoir is sized to provide reduction of the velocity of the circulating water in the hydronic system as it passes through the air purging reservoir on the suction side of the reservoir. This location has the lowest pressure within the system, and thus, the least amount of dissolved air in the circulating water. The air contained in the circulating water separates from the circulating water and collects in an upper portion of the air purging reservoir. The air purging reservoir has an air vent provided in the upper portion thereof to release the air collected in the reservoir. Preferably, the air purging reservoir is provided with four apertures positioned at 90° intervals around a peripheral wall thereof In this way, the air purging circulator may be oriented in any direction and the air vent will be positioned on the upper portion of the air purging reservoir.

In a preferred embodiment, the reservoir contains a separation media, such as marbles, wire mesh, or crumpled wire, to further slow the water flow and enhance separation of the air from the water.

Other objects, aspects and features of the present invention in addition to those mentioned above will be pointed out in or will be understood from the following detailed description provided in conjunction with the accompanying drawings.

DETAILED DESCRIPTION OF THE DRAWINGS

Figure 1:
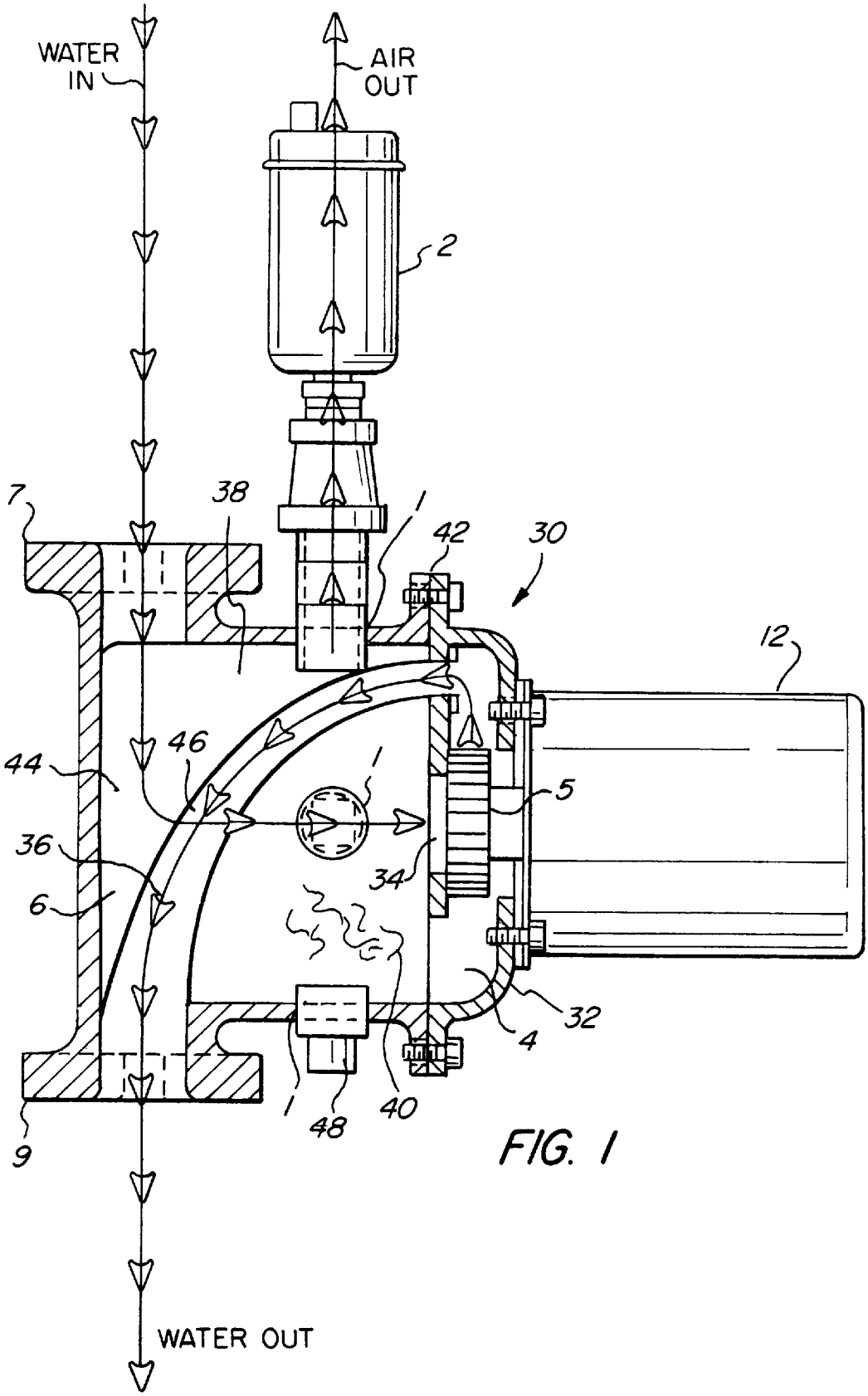
FIG. 1 is a cross-sectional view of a first embodiment of an air purging circulator in accordance with the invention.
Figure 2:
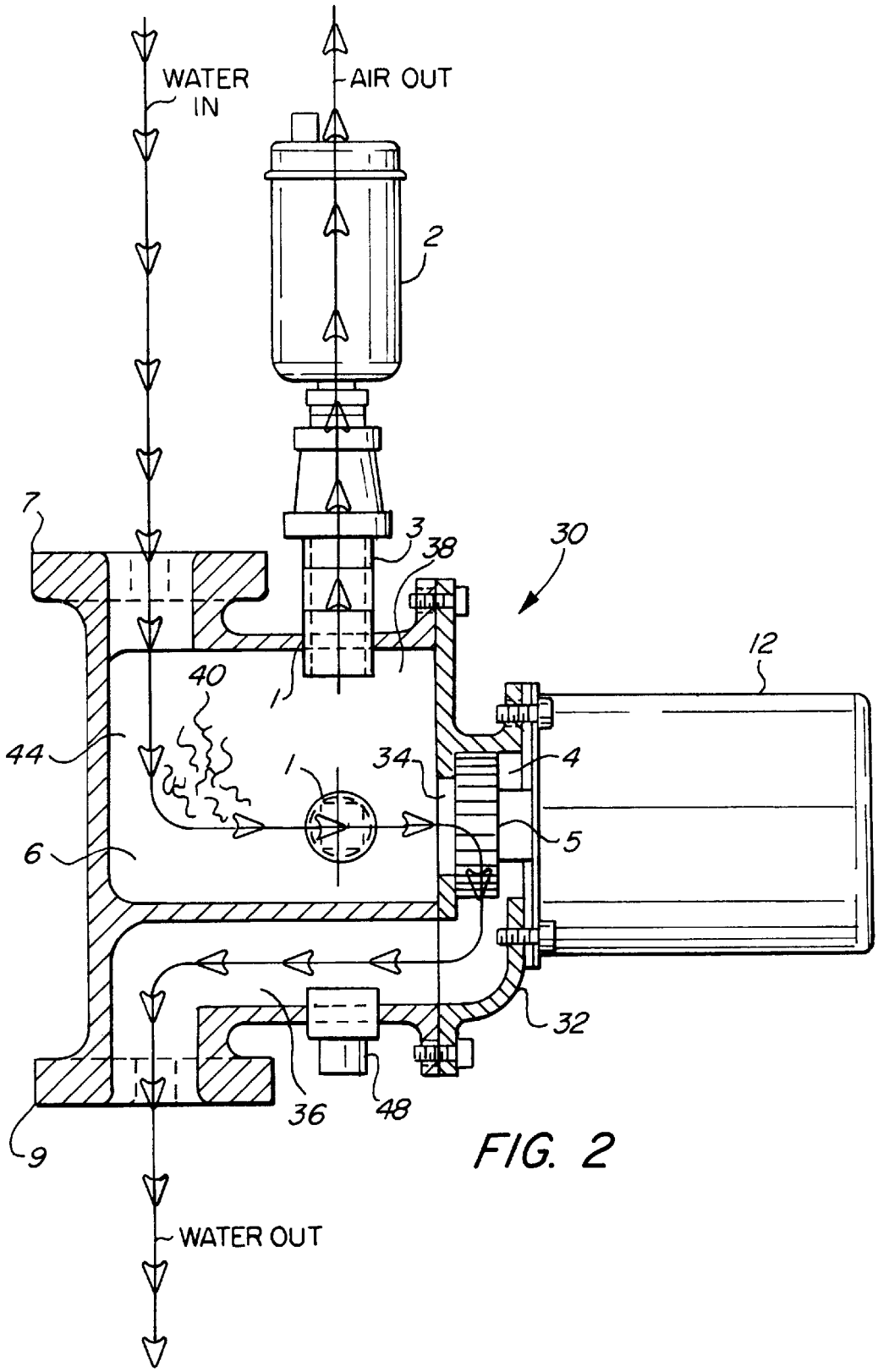
FIG. 2 is a cross-sectional view of a second embodiment of an air purging circulator in accordance with the invention.
Figure 3:
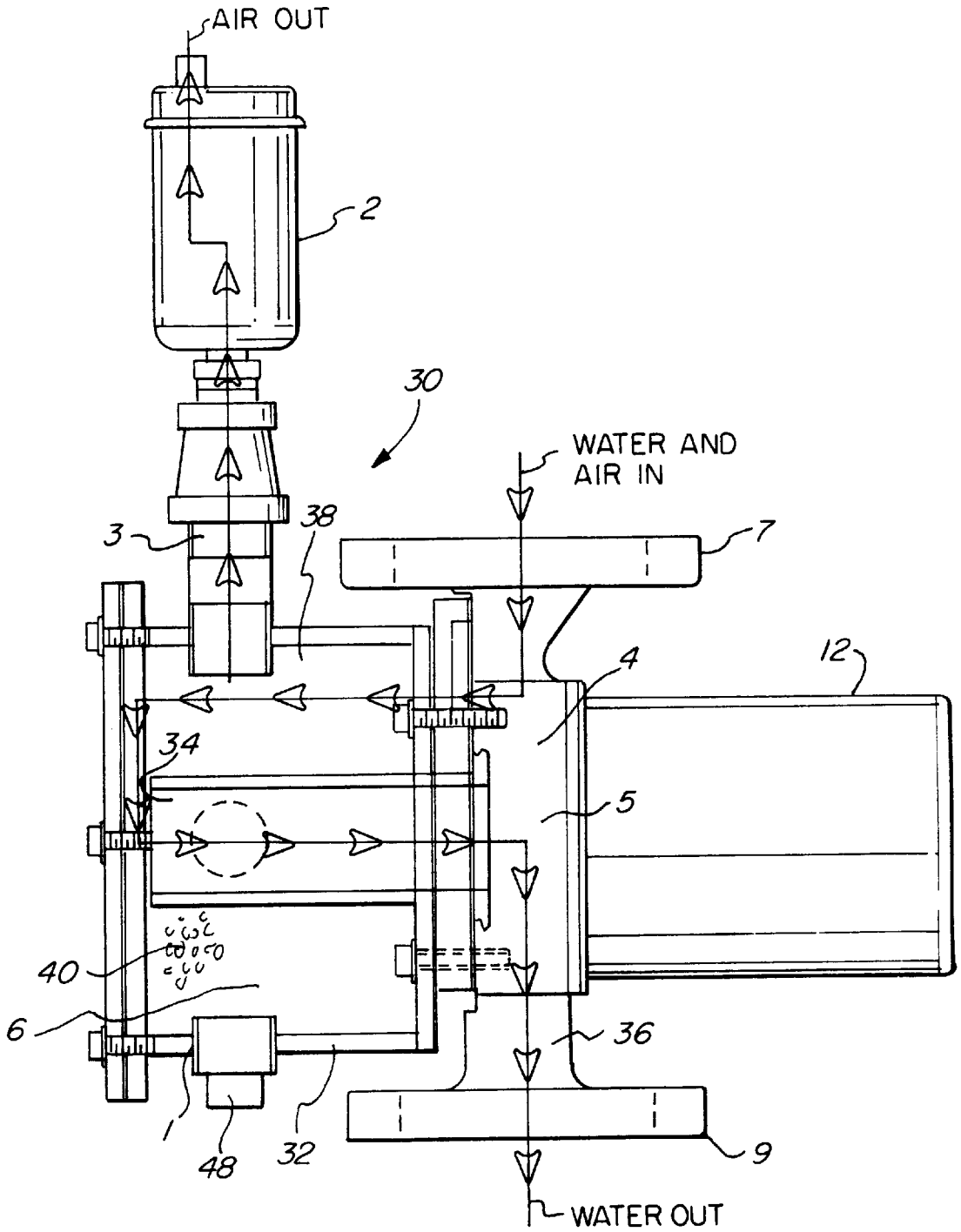
FIG. 3 is a cross-sectional view of a third embodiment of an air purging circulator in accordance with the invention.

The present invention has particular application in hydronic heating systems, i.e., circulating hot water heating systems found in many homes. Referring now to FIGS. 1–3, an air purging circulator 30 for a hydronic heating system is shown in three different embodiments. In the Figures, the same numbers refer to like elements in the different embodiments.

Circulator 30 will be identified by the trademark "AUTO PURGER." Circulator 30 comprises an electric motor 12, a pump housing 32, and an impeller 5. Pump housing 32 has a flanged inlet aperture 7, and a passage 8 leading from said inlet aperture 7 to an air purging reservoir 6. An outlet from the air purging reservoir 6 has an outlet aperture 34 connected to an impeller chamber 4, such that the reservoir 6 is on the upstream, or suction side, of the impeller chamber. Impeller chamber 4 is connected by a passageway 36 to a flanged outlet aperture 9 in pump housing 32. The impeller chamber preferably connects to the flanged outlet aperture 9 in the pump housing 32 by a curved tube 46 that extends from the impeller chamber 4, at the inlet aperture side 42 of the housing, to the outlet aperture 9, as shown in FIG. 1.

Impeller 5 for pumping water in the hydronic heating system is operably connected to motor 12. Impeller 5 is located within impeller chamber 4. Thus the air purging reservoir 6 is located on the suction side of the impeller 5 in circulator 30.

Flanged inlet aperture 7 and flanged outlet aperture 9 are axially aligned, so that the circulator 30 may be installed in retrofit applications in place of an existing conventional circulator without requiring repiping, drainage of the system, or other time-consuming and expensive alterations of the existing hydronic heating system. Moreover, the distance between flanged inlet aperture 7 and flanged outlet aperture 9 is selected to be consistent with industry standards for existing circulators, to simplify installation of the circulator 30 into an existing hydronic heating system. The flanges associated with the inlet aperture 7 and outlet aperture 9 are preferably secured in a manner allowing rotation of the flanges relative to the housing 32. In this manner, the air purging circulator 30 can easily be retrofitted into existing systems that have mating flanges on installed pipes, because the flanges on the circulator 30 may easily be oriented to match up with the existing flanges in the preexisting heating system. Rotation of the flanges of the inlet and outlet apertures 7, 9 may be provided by a threaded connection between the flange and a nipple extending from the circulator 30, or by a retaining collar for the flange having sealing means between the flange and the collar.

In preferred embodiments, shown in FIGS. 1 and 2, the flanged inlet aperture 7 and flanged outlet aperture 9 are positioned on one end 44 of air purging reservoir 6 opposite from the motor 12. This configuration provides the added advantage of fitting the circulator 30 into tight spaces, as where existing piping is fitted close to a wall. The provision of the flanged inlet aperture 7 and flanged outlet aperture 9 at end 44 of air purging reservoir 6 allows the circulator 30 to fit into the existing space, very nearly flush against a wall, where piping is fitted close to the wall. As noted above, in the embodiment of FIG. 1, a curved tube 46 preferably connects the impeller chamber 4 to the flanged outlet aperture 9 of pump housing 32. The curved tube 46 is a smooth gradually curved tube to provide a smooth transition from the impeller chamber to the outlet, and is believed to have a better flow rate and to reduce turbulence and mixing of air into the water than a system where a winding path is provided from the impeller chamber to the outlet.

Housing 32 and reservoir 6 contained therein are preferably cylindrical in shape to simplify installation and to provide a consistent reservoir volume regardless of orientation; however, other shapes may be used if desired. The air purging reservoir 6 is sized to permit reduction of velocity of water in the hydronic system, and is located to remove air at the point of lowest pressure in the system. This causes air bubbles contained in the water to separate from the water by and to be collected in an upper portion 38 of the air purging reservoir 6. The air purging reservoir 6 has an air vent 2 provided in its upper portion 38 to release air collected in the air purging reservoir 6.

The air purging reservoir 6 is provided with four threaded apertures 1 around a peripheral wall thereof at positions 90° apart, for connecting air vent 2 to the air purging reservoir 6 using a nipple 3. The apertures are aligned with the axis of the two flanges 7 and 9 and at positions 90° away therefrom. The provision of apertures 1 at these positions allows the air purging circulator 30 to be oriented in any direction, and the air vent 2 can be installed in the upper portion 38 of the air purging reservoir 6. The apertures that are not used for the air vent 2 will be plugged with a suitable threaded plug 48.

The passage leading from the inlet aperture 7 to the air purging reservoir 6 may comprise a tube extending into the air purging reservoir 6 or the tube may be omitted. The outlet 34 from the air purging reservoir 6 may comprise a tube extending from the air purging reservoir 6 to the impeller chamber 4 (as in FIG. 3) or such tube may be omitted.

The air purging circulator may be an empty space; however, preferably, the air purging circulator 30 contains media 40 that assists in inducing the separation of air from the water. Reservoir 6 is at least partially filled with separation media 40 to encourage separation of air bubbles from the water. Media 40 may comprise a randomly stacked series of spherical materials such as marbles or it may comprise packings of the type used in packed towers as are known in the art of chemical process equipment, or it may comprise a mesh or other material, such as a crumpled wire media. The separation media acts to divert the water flow into numerous paths, further reducing the water velocity, to allow further residence time for separation of air bubbles from the water. It is noted that the curved tube 46 can also serve such function.

Referring now to FIGS. 1–4, an air/water mixture in a hydronic heating system enters the circulator through aperture 7 in housing 2, then enters the air purging reservoir 6. Air purging reservoir 6 is sized sufficiently large so as to allow the mixture to reduce its speed. Air released by the low pressure, or that is moving with the water, separates by gravity from the water and collects in the upper end 38 of the reservoir 6. The air is then vented out through automatic vent 2. Vent 2 does not allow water to pass therethrough. Vent 2 is attached to reservoir 6 by a nipple 3 screwed into threaded aperture 1. In a typical use, one air vent 2 will be installed in one of the apertures 1 after it is determined which aperture 1 will be topmost.

After separation of the air/water mixture in reservoir 6, the water flows into impeller chamber 4 by suction from impeller 5. The amount of dissolved air in the water in impeller chamber 4 is significantly lower than the amount of air in the water entering reservoir 6. The water in impeller chamber 4 does not contain enough air to stall the system. (In prior art systems the entire heating system would stall if enough air entered impeller chamber 4, so that the impeller was spinning in the trapped air instead of pumping water through the system.) After a few cycles of the water through the air purging circulator 30 the smaller pockets of air disappear, eliminating banging and other noises associated with air in the hydronic system.

Figure 4:
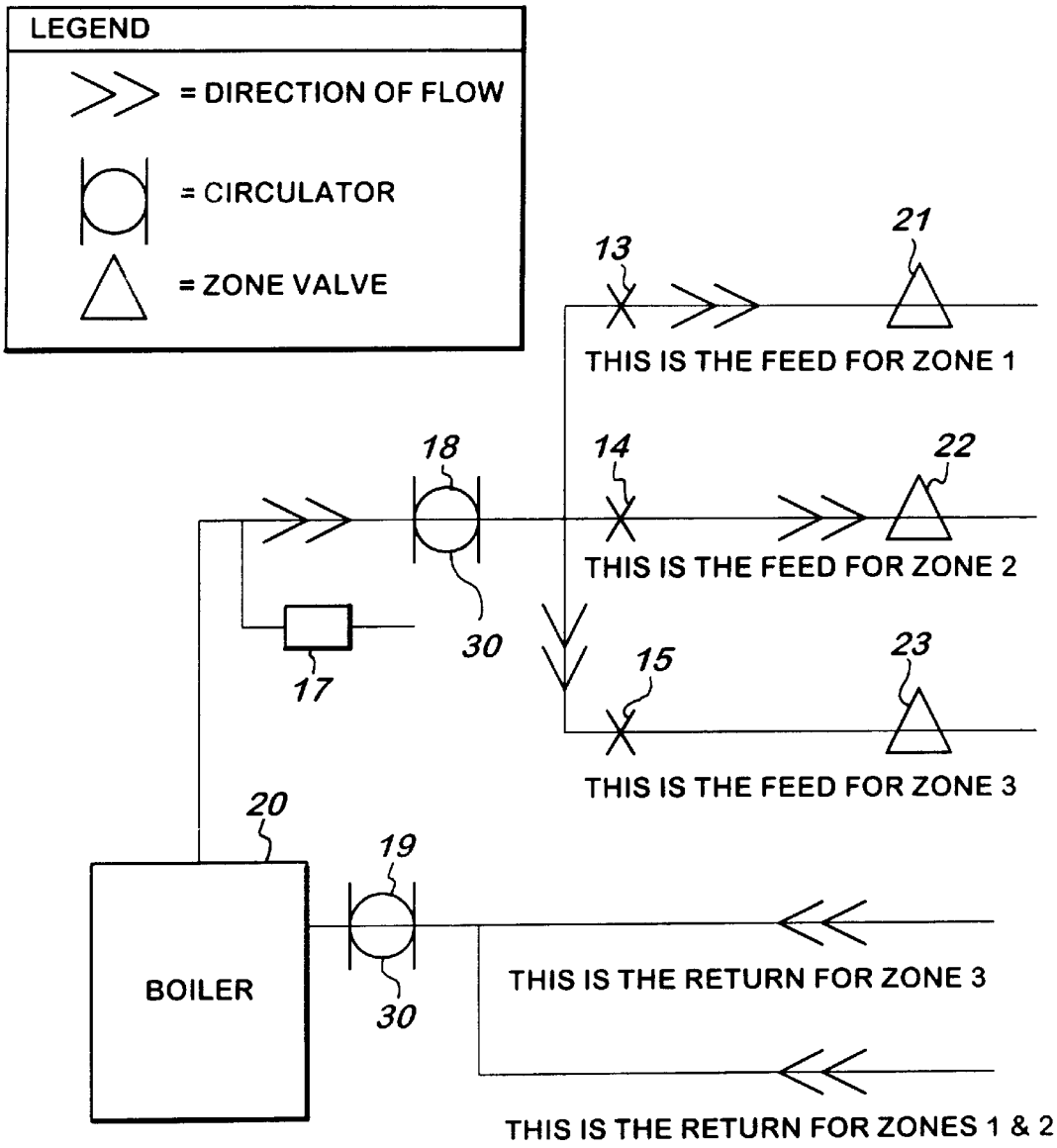
FIG. 4 is a schematic illustration of a hydronic heating system incorporating the air purging circulator of the present invention.

Referring now to FIG. 4, the air purging circulator 30 is best located in the hydronic heating system in one of two locations 18 or 19. If the air purging circulator 30 is located in other places more air purging circulators will be needed. Operation of the system is as follows. Fill valve 17 is opened and water fills the system until air stops coming out of vent 2 and the pressure in the system equalizes. The air purging circulator 30 moves the mixture around the system. As the mixture enters reservoir 6 the air is eliminated from vent 2. If one of the three zones 21, 22, 23, stalls or stops heating, then one of the valves 13, 14, 15, for the zones with the least amount of restriction must be shut, to force the rest of the mixture through the air purging circulator 30. Once water is flowing through a problem zone the valve to that zone must be shut to force the water through the final zone. Once the final zone is flowing, all valves 13, 14, 15. are opened and flow will be established in all zones. One zone will be moving at all times because the air purging circulator 30 will never stall the system. If the system has only one zone then these steps are not needed.

Accordingly, the present invention provides a new and useful improvement in the filed of hydronic heating systems, by providing for elimination of dissolved air in the circulating water in the heating system.

I claim:

1. An air purging circulator for a hydronic heating system, comprising:

a motor;

a pump housing having a flanged inlet aperture and a flanged outlet aperture, said inlet aperture connecting to an air purging reservoir, said air purging reservoir being on a suction side of an impeller chamber, an outlet from said air purging reservoir connecting to said impeller chamber, said impeller chamber connecting to said flanged outlet aperture in said pump housing; said flanged inlet aperture and said flanged outlet aperture of said pump housing being axially aligned and being located at one end of said pump housing opposite from said motor;

impeller means for pumping water in said hydronic heating system operably connected to said motor and located within said impeller chamber;

said air purging reservoir being sized to permit reduction of velocity of circulating water in the hydronic system through said air purging reservoir, air contained in the circulating water separating from the circulating water while passing through said air purging reservoir and collecting in an upper portion of said air purging reservoir, said air purging reservoir having an air vent provided in said upper portion thereof to release air collected in said reservoir.

2. An air purging circulator in accordance with claim 1 wherein said air purging reservoir is sized to provide a sufficient residence time of water in said reservoir to permit effective separation of air from the water.

3. An air purging circulator in accordance with claim 2 wherein said reservoir contains a separation media.

4. An air purging circulator in accordance with claim 3 wherein said separation media comprises a mesh-like material.

5. An air purging circulator in accordance with claim 3 wherein said separation media comprises a wire material.

6. An air purging circulator in accordance with claim 3 wherein said separation media comprises an array of spherical elements.

7. An air purging circulator for a hydronic heating system in accordance with claim 2, wherein said air purging reservoir is provided with four apertures around a peripheral wall thereof for connecting said air vent to said air purging reservoir, whereby said air purging circulator may be oriented in any direction and said air vent may be positioned in said upper portion of said air purging reservoir.

8. An air purging circulator in accordance with claim 7, wherein said apertures are positioned at 90° intervals around said peripheral wall.

9. An air purging circulator in accordance with claim 1, wherein a smooth gradually curved tube connects said impeller chamber to said flanged outlet aperture of said pump housing.

10. An air purging circulator in accordance with claim 1, wherein one or more of said flanged inlet aperture and said flanged outlet aperture have a flange which is rotatably secured relative to said pump housing.

11. An air purging circulator in accordance with claim 1, wherein said impeller chamber is connected to said flanged outlet aperture of said pump housing by a channel formed in said pump housing.

12. An air purging circulator for a hydronic heating system, comprising:

a motor;

a pump housing mounted to said motor, said pump housing having a flanged inlet aperture and a flanged outlet aperture, said flanged inlet aperture and said flanged outlet aperture of said pump housing being axially aligned, said flanged inlet aperture and said flanged outlet aperture of said pump housing being located at one end of said pump housing opposite from said motor, said inlet aperture connecting to an air purging reservoir, said air purging reservoir being on a suction side of an impeller chamber, an outlet from said air purging reservoir connecting to said impeller chamber, said impeller chamber connecting to said flanged outlet aperture in said pump housing by a curved tube;

impeller means for pumping water in said hydronic heating system operably connected to said motor and located within said impeller chamber;

said air purging reservoir being sized to permit reduction of velocity of circulating water in the hydronic system through said air purging reservoir, air contained in the circulating water separating from the circulating water while passing through said air purging reservoir and collecting in an upper portion of said air purging reservoir, said air purging reservoir having an air vent provided in said upper portion thereof to release air collected in said reservoir, said air purging reservoir being provided with four apertures s positioned at 90° intervals around a peripheral wall thereof for connecting said air vent to said air purging reservoir, whereby said air purging circulator may be oriented in any direction and said air vent may be positioned in said upper portion of said air purging reservoir.

13. An air purging circulator in accordance with claim 12 wherein said reservoir contains a separation media.

14. An air purging circulator in accordance with claim 13 wherein said separation media comprises a mesh-like material.

15. An air purging circulator in accordance with claim 13 wherein said separation media comprises a wire material.

16. An air purging circulator in accordance with claim 13 wherein said separation media comprises an array of spherical elements.

17. An air purging circulator in accordance with claim 12, wherein one or more of said flanged inlet aperture and said flanged outlet aperture have a flange which is rotatably secured relative to said pump housing.

18. An air purging circulator in accordance with claim 12, wherein said impeller chamber is connected to said flanged outlet aperture of said pump housing by a channel formed in said pump housing.

19. An air purging circulator for a hydronic heating system, comprising:

a motor;

a pump housing having an inlet aperture and an outlet aperture, said inlet aperture connecting to an air purging reservoir, said air purging reservoir being on a suction side of an impeller chamber, an outlet from said air purging reservoir connecting to said impeller chamber, said impeller chamber connecting to said outlet aperture in said pump housing; said inlet aperture and said outlet aperture of said pump housing being axially aligned and being located at one end of said pump housing opposite from said motor;

impeller means for pumping water in said hydronic heating system operably connected to said motor and located within said impeller chamber;

said air purging reservoir being sized to permit reduction of velocity of circulating water in the hydronic system through said air purging reservoir, air contained in the circulating water separating from the circulating water while passing through said air purging reservoir and collecting in an upper portion of said air purging reservoir, said air purging reservoir having an air vent provided in said upper portion thereof to release air collected in said reservoir.

20. An air purging circulator in accordance with claim 19, wherein a smooth gradually curved tube connects said impeller chamber to said outlet aperture of said pump housing.

21. An air purging circulator in accordance with claim 19, wherein said impeller chamber is connected to said outlet aperture of said pump housing by a channel formed in said pump housing.

22. An air purging circulator in accordance with claim 19 wherein said air purging reservoir is sized to provide a sufficient residence time of water in said reservoir to permit effective separation of air from the water.

23. An air purging circulator in accordance with claim 22 wherein said reservoir contains a separation media.

24. An air purging circulator for a hydronic heating system in accordance with claim 19, wherein said air purging reservoir is provided with four apertures around a peripheral wall thereof for connecting said air vent to said air purging reservoir, whereby said air purging circulator may be oriented in any direction and said air vent may be positioned in said upper portion of said air purging reservoir.

25. An air purging circulator in accordance with claim 24, wherein said apertures are positioned at 90° intervals around said peripheral wall.

* * * * *